US005161663A

United States Patent [19]

Cupp et al.

[11] Patent Number: 5,161,663

[45] Date of Patent: Nov. 10, 1992

[54] CONVEYER SYSTEM FOR ROD-LIKE ARTICLES

[75] Inventors: William A. Cupp, Richmond, Va.; David M. Hawkins, Saunderton, England; Albert D. Seim, II, Richmond, Va.; Clive Watson, Saunderton, England

[73] Assignee: Molins PLC, Milton Keyes, England

[21] Appl. No.: 599,017

[22] Filed: Oct. 17, 1990

[30] Foreign Application Priority Data

Oct. 20, 1989 [GB] United Kingdom ..... 8923637.6

[51] Int. Cl.[5] ..... B65G 1/00

[52] U.S. Cl. ..... 198/347.2; 198/457; 198/452

[58] Field of Search ..... 198/448, 457, 452, 347.2, 198/787

[56] References Cited

U.S. PATENT DOCUMENTS

| | | | |
|---|---|---|---|
| 3,608,972 | 9/1971 | Rudszinat | 198/457 X |
| 4,042,112 | 8/1977 | Molins et al. | 198/448 X |
| 4,084,685 | 4/1978 | Hollenton et al. | 198/624 X |
| 4,311,229 | 1/1982 | Bennett | 198/457 |
| 4,551,040 | 11/1085 | Kaspariek et al. | 198/448 X |
| 4,744,453 | 5/1988 | Krause et al. | 198/347.2 |

*Primary Examiner*—D. Glenn Dayoan

*Attorney, Agent, or Firm*—Antonelli, Terry, Stout & Kraus

[57] ABSTRACT

A receiver unit for a pneumatic distribution system for rod-like articles, particularly cigarette filter rods, includes multiple vertically spaced devices (10) each of which receives axially moving rods and transfers them into a transversely-moving stream, the streams from the devices extending in different directions and being subsequently combined in a common junction zone (38, 46) to form a combined stream of increased height. Each device may cooperate with an adjacent channel (166) forming reservoir for rods and including detectors (168, 170) controlling conveyance of the transversely moving steam.

11 Claims, 5 Drawing Sheets

168
166
170
164
140
129
142
160
162
120
126
110
A
132
128
122

CONVEYER SYSTEM FOR ROD-LIKE ARTICLES

BACKGROUND OF THE INVENTION

This invention relates to a conveyor system for rod-like articles, particularly for use as or with a receiving unit for a pneumatic conveying system for such articles.

Pneumatic conveying systems in which rod-like articles are conveyed axially in line through a conduit from a distributing unit to a receiver unit by means of pressure air are well known in the tobacco industry and are commonly used for conveying filter rod lengths from a filter rod making machine to one or more machines for attaching filters to tobacco lengths to produce filter cigarettes. Examples of such systems are disclosed in British patent specifications Nos. 1561560 and 2059901.

SUMMARY OF THE INVENTION

According to one aspect of the invention a conveyor system for rod-like articles comprises a plurality of spaced devices each for converting a stream of rod-like articles moving in an endwise direction into a stream of articles moving in a direction transverse to their lengths, conveyor means for moving a stream of articles in a direction transverse to their lengths from each of the devices to a junction zone at which a combined stream, preferably of increased height, is formed, wherein the conveyor means comprises at least two conveyor means extending to said junction zone in different, non-parallel directions. There may be separate conveyor means extending between each of said devices and the junction zone. Each such conveyor means may comprise means defining a path for a single-layer or a multi-layer stream of articles, and may have stationary or movable wall means: in other words the conveyor means may comprise a simple passageway or may be at least partly defined by movable conveyor means such as an endless band.

In a preferred arrangement there are at least three of said devices, which may be located in vertically spaced positions. The conveyor means may therefore comprise means defining paths having different inclinations.

Each of said devices may include a pair of conveyors (preferably rollers) between which each rod is received and subsequently moved between the conveyors in a direction transverse to its length. Frictional engagement of the rod with the conveyors may serve to retard axial movement of the rod. Pneumatic means may be provided to deflect successive rods towards the conveyors, e.g. into the nip between rollers arranged with their axes substantially parallel to the lengths of the rods.

According to another aspect of the invention a conveyor system for rod-like articles comprises a plurality of spaced devices each for converting a stream of rod-like articles moving in an endwise direction into a stream of articles moving transverse to their lengths, conveyor means for moving a stream of articles transverse to their lengths from each of the devices to a junction zone at which a combined stream, preferably of increased height, is formed, wherein said devices a re arranged in vertically spaced positions. Preferably the devices are in vertical alignment or sufficiently close thereto for parts thereof to be superposed. The conveyor means may include downwardly and/or upwardly inclined portions and/or horizontal portions. Alternatively the conveyor means may include separate horizontal portions extending form each of the devices, which portions lead into separate vertical conveying portions extending to said junction zone.

According to a further aspect of the invention a conveyor system for rod-like articles comprises at least three spaced devices each for converting a stream of rod-like articles moving in an endwise direction into a stream of articles moving in a direction transverse to their lengths, and conveyor means for moving a stream of articles in a direction transverse to their lengths from each of the devices to a common junction zone at which a combined stream, preferably of increased height, is formed. Preferably the conveyor means includes means defining three separate paths extending in different directions. The three devices may be vertically spaced.

According to a still further aspect of the invention a conveyor system for rod-like articles comprises at least one device for converting a stream of rod-like articles moving in an endwise direction into a stream of articles moving in a direction transverse to their lengths, driven conveyor means for receiving said stream of articles moving in a direction transverse to their lengths, and receiver means communicating with a path for articles between said device and said driven conveyor means, said reservoir means including spaced side walls between which said articles may be confined and means for detecting a level of articles between said walls, said driven means being at least partly controlled by said detecting means. Preferably said reservoir comprises a substantially vertical channel arranged substantially immediately down stream of said device.

In each of its aspects the invention is particularly suitable for incorporation in a system for conveying filter rods from a pneumatic rod distribution system to a filter attachment machine. Thus the systems of the invention may be incorporated in/or adjacent a filter attachment machine and each of said devices may receive rods from a single pneumatic line of said distribution system.

BRIEF DESCRIPTION OF THE DRAWINGS

The invention will be further described, by way of example only, with reference to the accompanying diagrammatic drawings, in which.

DETAILED DESCRIPTION OF THE PREFERRED EMBODIMENTS

Figure 1:
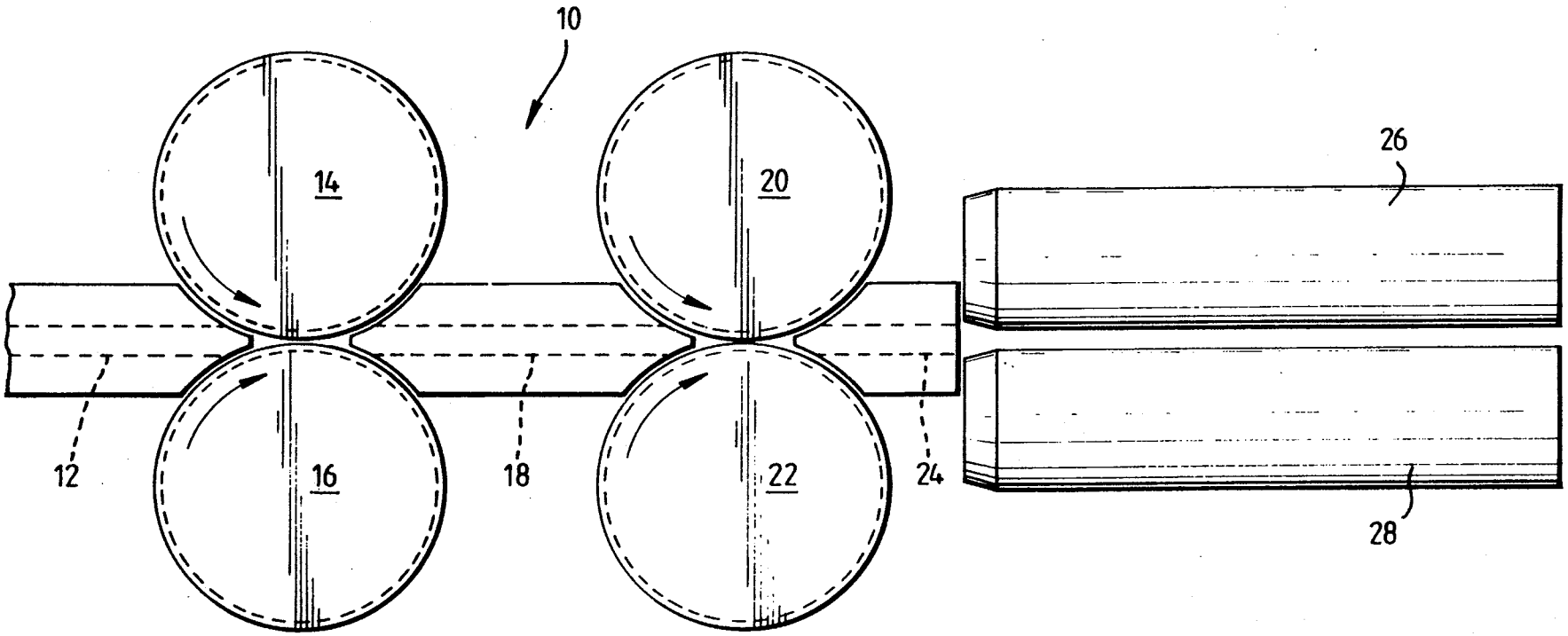
FIG. 1 is a side view of part of a receiving station of a pneumatic rod conveying system.

FIG. 1 shows a receiving station 10 for filter rods pneumatically delivered in an axial direction along an extended tube terminating in the vicinity of a guide channel 12. Commonly the channel 12 is at the downstream end of a curved length of tub in which the rods are received moving in a substantially vertical direction and leave moving in a substantially horizontal direction. Downstream of the channel 12 individual rods pass between spaced control rollers 14, 16 each of which is driven and has a concave cross-sectional periphery: these rollers regulate the speed of rods received at the station 10. Each rod is passed on by the control rollers 14, 16 at a regulated speed and passes along a short length of further guide channel 18 to a pair of driven spacer wheels 20, 22, which are similar to the wheels 14, 16 except that they have a higher peripheral speed, so that rods issuing from the wheels 20, 22 are axially spaced apart.

Downstream of the wheels 20, 22 individual rods pass along a further short guide channel 24 to a region in which each rod is axially adjacent one side of the nip of a pair of driven hardened steel rotating rollers 26, 28 extending parallel to the axial path of the rod.

Figure 2:
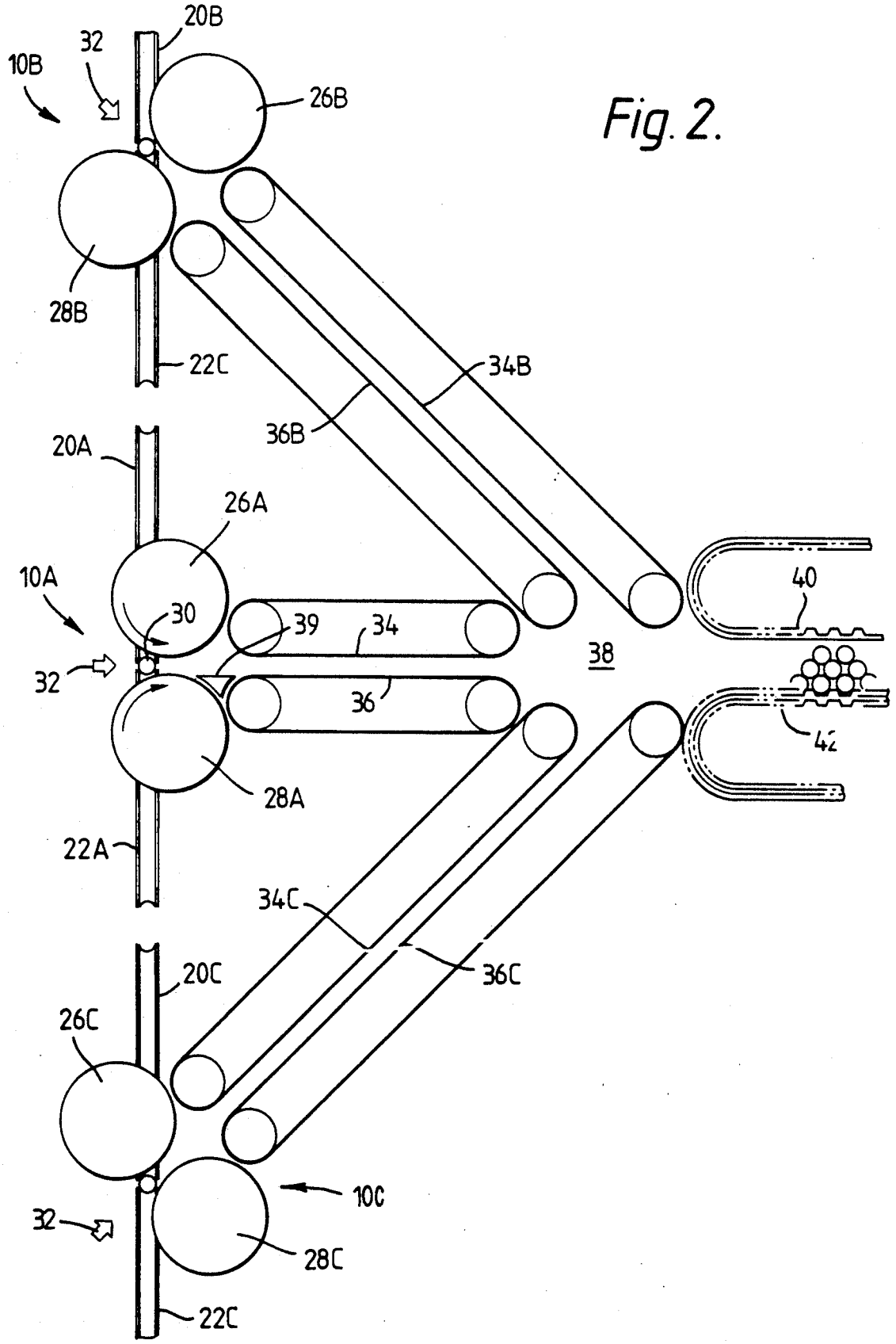
FIGS. 2-5 are respectively side views of different rod conveying systems incorporating receiving stations similar to that of FIG. 1.

Referring also to FIG. 2, and particularly tot he receiving station 10A, which is substantially identical to the receiving station 10 of FIG. 1, each rod 30 issuing from between spacer wheels 20A, 22A is subjected to one or more transverse air jets, indicated at 32, which are sufficiently forceful to ensure that each rod is deflected into the nip between the rollers 26A and 28A. Axial movement of each rod is thereby arrested, by virtue of the frictional engagement with the surface of the rollers 26A, 28A and the rods are urged into an through the nip between the rollers by the air jet or jets and the rotation of the rollers. Preferably there are several air jets arranged in an axial direction relative to the direction of movement of the rod 30, so that each rod will continue to be subjected to an air jet irrespective of slight differences in final axial position of rods contacting the rollers 26A, 28A. Note that the axial length of the rollers 26A, 28A is significantly greater than the length of a single rod 30.

The transverse width of the nip between the rollers 26A, 28A is such to ensure that each rod 30 is firmly gripped but without damaging it, so that each rod is axially stationary before passing through the nip and so that a transverse driving force is imparted to each rod by rollers 26A, 28A for assistance with transverse conveyance downstream of the rollers.

As shown in FIG. 2 the rods are received downstream of the rollers 26A, 28A between upper and lower conveyor bands 34, 36 which convey a single row stream of rods moving in a direction transverse to their lengths towards a junction zone 38. One or more dead-plates, as indicated at 39, may be provided between the rollers 26A, 28A and the upstream ends of the conveyors 34, 36, so as to ensure that a single row stream is maintained in the region immediately downstream of the rollers.

The system of FIG. 2 comprises the receiving station 10A and basically similar receiving stations 10B and 10C. The stations 10B and 10C differ from the station 10A in that the transverse lines passing through the nip between the steel rollers 26B, 28B and 26C, 28C are inclined to the planes of the respective control rollers 20B, 22B and 20C, 22C. Similarly, the air jets 32 at the stations 10B and 10C are inclined so that they continue to direct rods toward the nips between the respective rollers 26B, 28B and 26C, 28C.

The receiving stations 10A, 10B and 10C are in vertical alignment and while the conveyors 34 and 36 define a substantially horizontal path leading to the junction zone 38, respective conveyors 34B, 36B and 34C, 36C are inclined so as to direct rods received at the respective stations 10B and 10C to the common junction zone 38.

In the junction zone 38 a multi-layer stream of rods is formed and subsequently conveyed away by a pair of conveyor bands 40, 42. Sensor means (not shown) may be provided in the junction 38 for controlling the formation of the multi-layer stream (e.g. for modifying or controlling the speed of conveyor bands 40,42). The conveyor bands 40, 42 convey a multi-layer stream of rods towards the hopper of a filter attachment machine, either directly or by way of a buffer reservoir.

I will be appreciated that the rods 30 may not all be arrested in precisely the same axial position by the respective rollers 26, 28. Means may be provided, e.g. stationary guides and/or pneumatic means acting on the ends of the rods, for ensuring that all rods are eventually in alignment. Such means may influence the rods during passage between bands 34, 36 (or 34B, 36B or 34C, 35C), i.e. by the time they reach the junction zone 38, and/or during passage between the conveyor bands 40,42, i.e. downstream of the junction zone.

Figure 3:
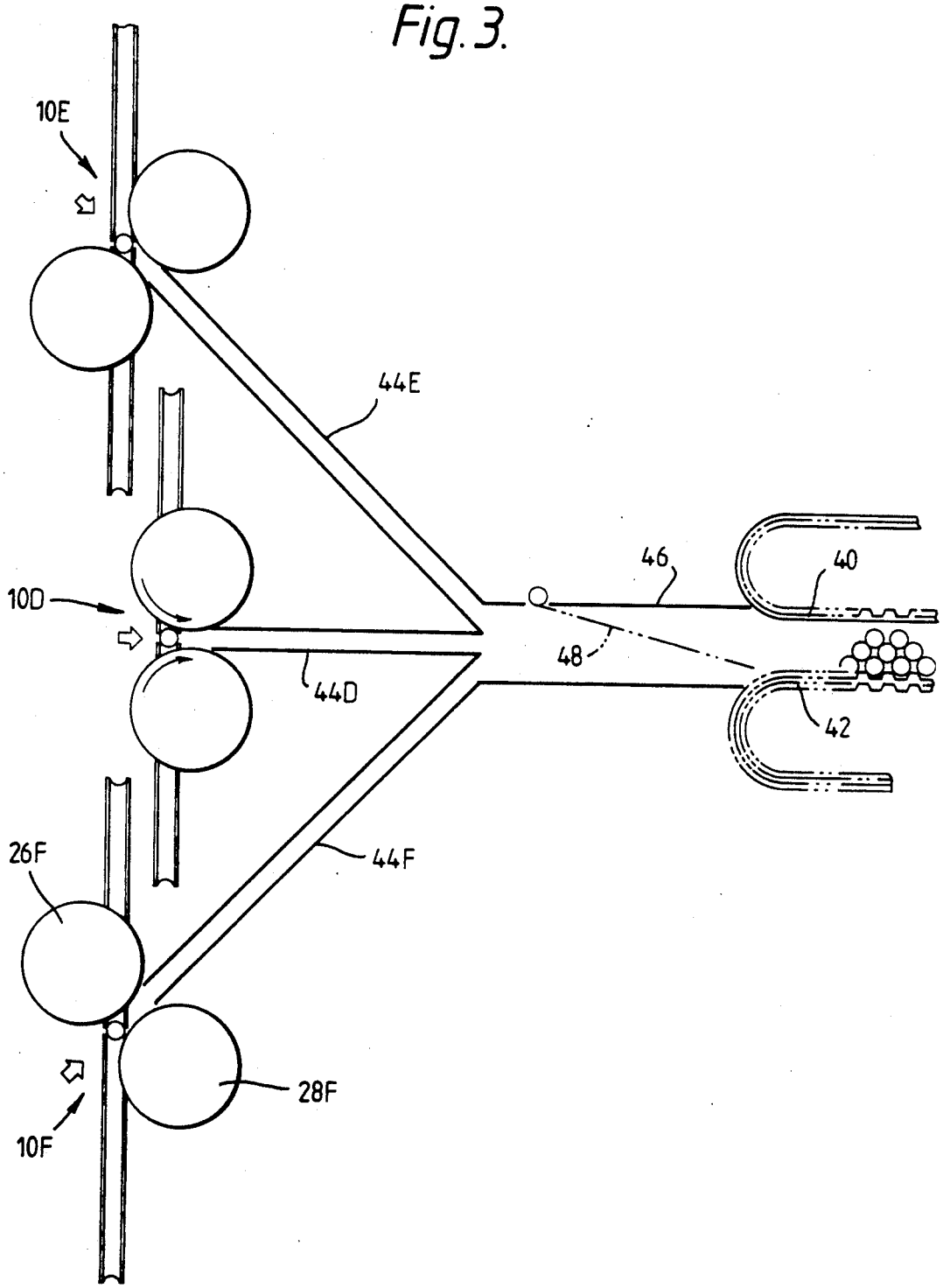

FIG. 3 shows a system which is somewhat similar to that of FIG. 2, incorporating receiving stations 10D, 10E and 10F which operate substantially as previously described. The conveyors 34, 36 etc. of FIG. 2 are, however, replaced by simple channels 44D, 44E and 44F conveying single row streams of filter rods to a common channel 46 in which a multi layer stream of rods is formed under control of a sensor 48. Conveyor bands 40, 42, at least partially controlled by the sensor 48, convey the multi-layer stream from the common channel 46 to the filter attachment machine, as before. Conveyance of at least the rods passing from the station 10F relies on transverse conveying force imparted by the nip of rollers 26F, 28F. Note that the system is slightly more compact than the system of FIG. 2, the station 10D being no longer in exact vertical alignment with the other stations.

Figure 4:
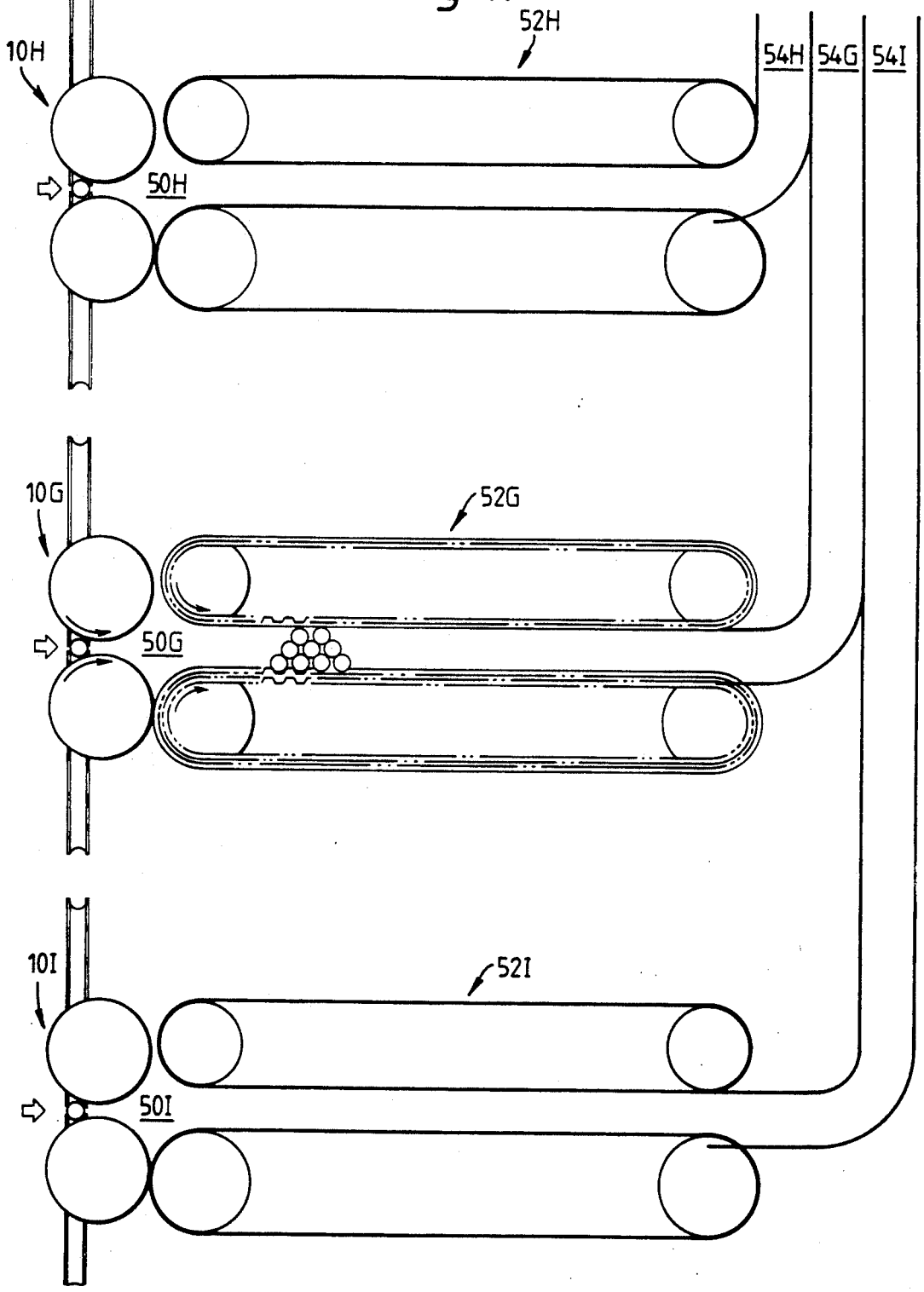

In the system of FIG. 4 three receiving stations 10G, 10H and 10I in vertical alignment respectively deliver rods directly to region 50G, 50H and 50I in which multi-layer streams or rods are formed and subsequently conveyed away by upper and lower conveyor bands 52G, 52H, and 52I. Downstream of the respective conveyor bands 52 the respective multi-layer streams pass to elevators, which may incorporate further bands (now shown), for producing parallel upwardly-moving streams 54G, 54H, and 54I. These streams are subsequential combined into a common stream for delivery to the filter attachment machine.

Note that, although in the systems shown in FIGS. 2-4 the receiving stations are in vertically-spaced positions, they could be in horizontally-spaced positions or in a non-linear arrangement. This may be advantageous when accommodating the stations on filter attachment machines not initially designed to take multiple or triple stations.

Figure 5:
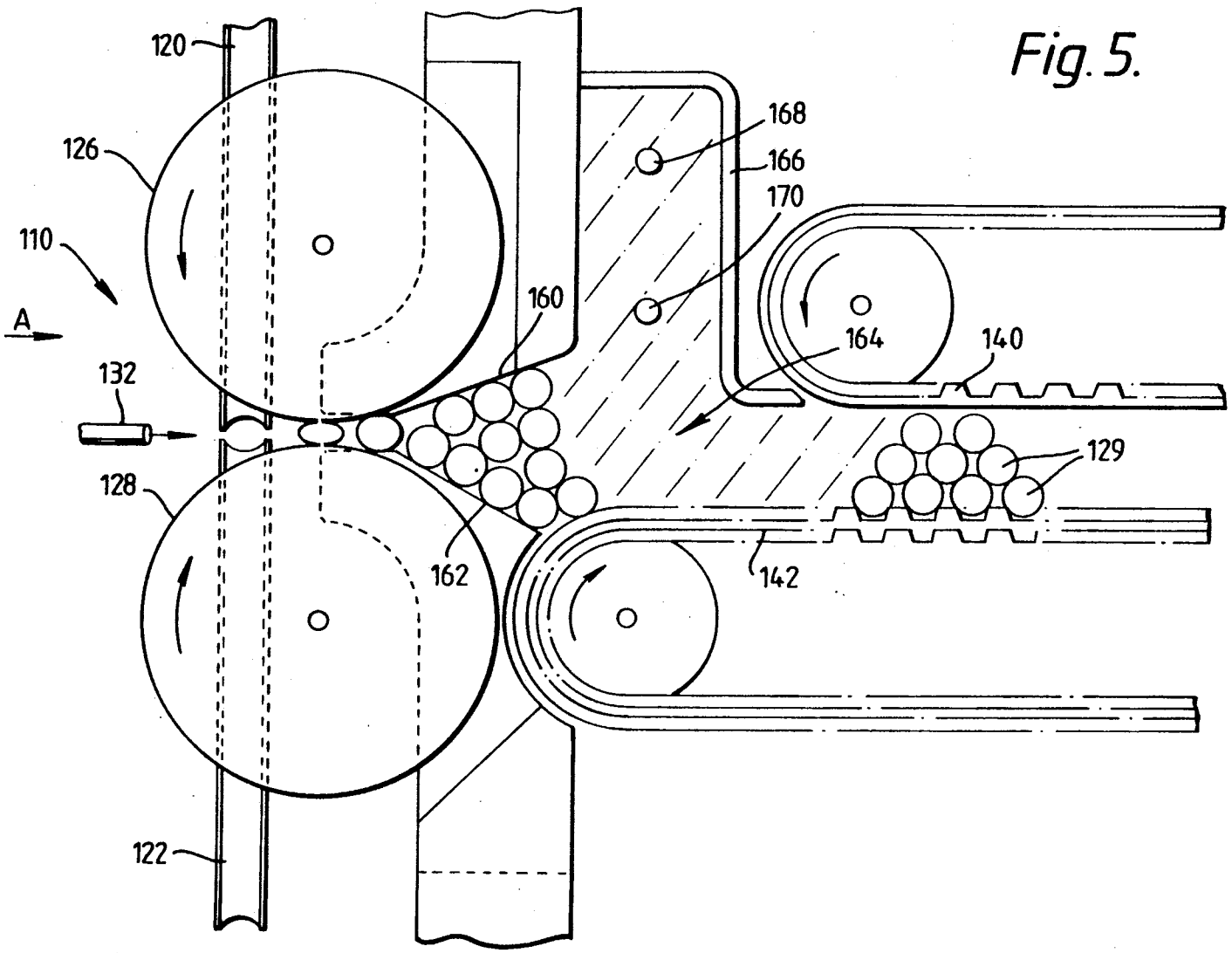

FIG. 5 is a side view of a receiving station 110 which is similar to that of FIG. 1 when viewed int eh direction of arrow A in FIG. 5. Steel rotating rollers 126, 128, similar tot he rollers 26, 28, receive axially-moving filter rods 129 from spacer wheels 120, 122, similar to the wheels 20, 22, and deliver them between diverging plate 160, 162 into a region 164 over the end of a lower conveyor band 142. Above the region 164 is a small vertical chimney or channel 166 and downstream of this channel is an upper conveyor band 140. The channel 166 has a width of about 30 mm and a height of about 65 mm, and contain upper and lower opto-electronic detectors 168, 170, spaced by about 40 mm. These dimension are not critical.

In operation, one or more air jets 132, which may be continuous, or pulsed in response to an opto-electronic sensor which detects the arrival of each filter rod 129, directs each rod towards the nip between the rollers 126 and 128. Filter rods 129 are thus axially retarded by friction and conveyed into the region 164 by the rollers 126, 128 and re conveyed away from the region by the conveyors 140, 142. The speed of the conveyors 140, 142 may be set to correspond with the average rate of receipt of filter rods at the receiving station. This speed may e modified in accordance with signals derived from the level detectors 168, 170. Thus, if the level of filter rods 129 in the channel 166 exceeds that of the upper detector 168 the speed of the conveyor bands 140, 142 is increased (e.g. by a predetermined amount, such as 10% or 20%); similarly if the level falls below that of the bands it is decreased by a corresponding amount.

As with the systems of FIGS. 2-4, the filter rods 129 may not be in complete axial alignment downstream of the rollers 126, 128: plough guides may complete alignment of the filter rods int he region 164 and/or between the upper and lower conveyor bands 140, 142. It may be that axial motion is not fully arrested by the rollers 126, 128 so that a rigid or cushioned "stop" (not shown) in the region of the downstream ends of the plates 160, 162 would be useful.

The gap between the rollers 126, 128, the rotational velocity of the rollers 126, 128, and also the velocity of the spacer wheels 120, 122 are all factors which affect the position at which axial movement of the successive filter rods 129 stops. It would be possible to use a signal derived form detection of the mean axial position at which filter rods 129 come to rest (e.g. by opto-electronic sensor means) as input to a feedback circuit which causes automatic adjustment of one or more of these factors to control the means top position appropriately.

In order to positively convey each filter rod 129 to the region 164 it is necessary for the rollers 126 and 128 to grip the rods relatively firmly. In so doing they cause some degree of distortion of each rod, i.e. they tend to deform it from a round to an oval shape. Generally, the filter rods recover adequately for this deformation. However, in order to minimise this effect, it may be advantageous to cause the rollers 126, 128 to rotate at different speeds, so that they induce rotation in each filter rod 129 as they convey it towards the region 164.

A receiver station such as that shown in FIG. 5 may be incorporated in any of the systems shown in FIGS. 2-4. On the other hand, a station such as that shown in FIG. 5 may be used in systems having only single or twin lines. Where there are multiple receiving station sit can be advantageous to have the stations both physically and functionally separate so as to allow maintenance or debris cleaning at one station without interference with the other station or stations.

Although each of the multiple system shown in FIGS. 2-4 indicate that the streams from each receiving station should be combined upstream of a hopper or other reservoir from which the filter rods are moved for further processing by the associated machine, it may be convenient to locate receiving stations at such positions that it is preferable to convey the streams separately to said hopper, i.e. without prior merging, in which case the hopper would form the junction zone for the respective steams.

Particularly where a receiving station is connected to a pneumatic transmission line along which the filter rods are transmitted at very high speeds, a second pair of control wheel similar to the wheel 14, 16 of FIG. 1, may be provided in order to more effectively dissipate excess velocity of filter rods gained during transmission. The first and second pairs of control wheels act in series on the filter rods.

We claim:

1. A conveyor system for rod-like articles, comprising a plurality of spaced devices each for converting a stream of rod-like articles moving in an endwise direction into a stream of articles moving in a direction transverse to their lengths, conveyor means for moving a stream of articles in a direction transverse to their lengths from each of the devices to a common junction zone at which a combined stream, preferably of increased height, is formed, wherein the conveyor means comprises at least tow conveyor means having portions extending towards said common junction zone in different, non-parallel directions, wherein each of said devices includes a pair of conveyors between which each rod is received and subsequently moved between the conveyors of the pair in a direction transverse to its length, said devices being vertically spaced, with mutually inclined conveyor means extending respectively from each device to said common junction zone.

2. A conveyor system as claimed in claim 1, wherein separate conveyor means extend between each of said devices and the junction zone.

3. A conveyor system as claimed in claim 2, including at least three of said devices located in vertically space positions.

4. A conveyor system as claimed in claim 1, including pneumatic means for deflecting successive rods towards said conveyors.

5. A conveyor system as claimed in claim 4, wherein said pneumatic means is pulsed.

6. A conveyor system for rod-like articles, comprising a plurality of spaced devices each for converting a stream of individual rod-like articles moving in an endwise direction into a multi-layer stream of articles moving transverse to their lengths, conveyor means for moving the multi-layer stream of articles from each of the devices to a junction zone at which a combined stream is formed, wherein said devices are arranged in vertically spaced positions and each of said devices includes a pair of conveyors between which each rod is received and subsequently moved between the conveyors in a direction transverse to its length, and wherein said conveyor means includes a plurality of further conveyors arranged one above the other for conveying respective multi-layer streams from respective ones of said spaced devices to said junction zones.

7. A conveyor system as claimed in claim 6, wherein the devices are in vertical alignment or sufficiently close thereto for parts thereof to be superposed.

8. A conveyor system as claimed in claim 6, wherein the conveyor means includes inclined portions.

9. A conveyor system as claimed in claim 7, wherein three devices are provided in vertically spaced positions.

10. A conveyor system for rod-like articles, comprising at least one device for converting a stream of rod-like articles moving in an endwise direction into a stream of articles moving in a direction transverse to their length, said device comprising opposed conveyors defining a nip between which individual articles are conveyed transversely into said stream, driven conveyor means for receiving said stream of articles moving in a direction transverse to their length, and reservoir means communicating with a path for articles between said device and said driven conveyor means, said reservoir means including spaced side walls defining a channel extending transversely from the path for articles conveyed between said device and said driver conveyor means, and between which said articles may be confined and means for detecting a level of articles between said walls, said driven conveyor means being at least partly controlled by said detecting means.

11. A conveyor system as claimed in claim 10, wherein said reservoir channel is substantially vertical and is arranged substantially immediately downstream of said device.

* * * * *